US005319380A

United States Patent [19]

Bruger

[11] Patent Number: 5,319,380

[45] Date of Patent: Jun. 7, 1994

[54] ANTENNA CURTAIN

[75] Inventor: Peter Bruger, Berlin, Fed. Rep. of Germany

[73] Assignee: Telefunken Sendertechnik GmbH, Berlin, Fed. Rep. of Germany

[21] Appl. No.: 936,931

[22] Filed: Aug. 27, 1992

[30] Foreign Application Priority Data

Aug. 28, 1991 [DE] Fed. Rep. of Germany ..... 4128502
Mar. 11, 1992 [DE] Fed. Rep. of Germany ..... 4207738

[51] Int. Cl.[5] ..... H01Q 21/12; H01Q 1/22

[52] U.S. Cl. ..... 343/813; 343/812; 343/815

[58] Field of Search ..... 343/813, 810, 812, 811, 343/815, 884, 885, 890, 878, 817, 818, 819; H01Q 21/12, 1/22

[56] References Cited

U.S. PATENT DOCUMENTS

| | | | |
|---|---|---|---|
| 1,964,190 | 6/1934 | Bohm et al. | 343/813 |
| 3,373,434 | 3/1968 | Lorenzo et al. | 343/813 |
| 3,618,110 | 11/1971 | Solberg | 343/792.5 |
| 5,146,233 | 9/1992 | Ursenbach | 343/815 |

FOREIGN PATENT DOCUMENTS

| | | | |
|---|---|---|---|
| 3212291C2 | 8/1990 | Fed. Rep. of Germany | H01Q 1/16 |

*Primary Examiner*—Donald Hajec
*Assistant Examiner*—Hoanganh Le
*Attorney, Agent, or Firm*—McGlew and Tuttle

[57] ABSTRACT

According to the invention, an antenna curtain, particularly a dipole curtain of an antenna in the decametric wave range is formed of a plurality of cables. Radiators are provided arranged essentially in a vertical plane, defining a radiator plane, in a plurality of rows located one atop another and in one column or in a plurality of columns next to one another. A line system device is provided for feeding the radiators of each column through conductive lines. A single catenary is provided to provide sufficient tension for the vertical or slightly inclined lines of the line system. An approximately horizontal spreader is arranged above each of the columns essentially perpendicularly to the radiator plane. The horizontal spreader is positioned beneath the catenary and above the topmost radiator, preferably spaced a small distance in height above the topmost radiator. In the case of plural columns, horizontal spreaders are preferably arranged at equal distance in height in all columns above the topmost radiator. At least two supporting cables of the radiators and lines are provided for a column and are attached on one spreader at distances b, b1, b2 etc. The approximately vertical supporting cables or approximately vertical lines of the line system, of one column are attached at their lower ends essentially non-yieldingly and are spaced farther apart from one another at the bottom (distances a, a1, a2, etc.) than at the top such that a>b, a1>b1, a2>b2.

11 Claims, 5 Drawing Sheets

ANTENNA CURTAIN

FIELD OF THE INVENTION

The present invention pertains to an antenna curtain, especially a dipole curtain of an antenna in the decametric wave range, the antenna curtain being formed mainly of wires or cables, with a plurality of radiators arranged essentially in a vertical plane, the radiators being in a plurality of rows located one on top of another and in one column or a plurality of columns next to one another.

BACKGROUND OF THE INVENTION

An antenna curtain, in which the individual columns are suspended on two catenaries, which extend at a parallel distance from one another, is disclosed in DE 32,12,291 C2. An individual column of the prior-art curtain is closed at the top with a horizontal supporting beam, whose ends are attached to the catenaries and which is oriented perpendicularly to the plane of the radiator. Starting from the supporting beam of the curtain which is farthest away to the side, the two catenaries converge toward lateral tensioning cables toward the lateral edges. The supporting cables of one column are suspended, at spaced locations from one another, on the supporting beam. The holding cables of one column are attached at the bottom directly to holding points, and the distances between the holding points agree with the distances of the supporting cables. Therefore, the supporting cables, holding cables, and lines (with the exception of the horizontal connection lines) extend in parallel to one another in one column. When this prior-art curtain is deflected by a wind acting on it orthogonally, the supporting beams are rotated like a swing, which leads to an undesired reduction of the distance between lines and radiators. The behavior in wind is also influenced by the slack curve of the catenaries, because this curve determines the distances in height between the topmost radiator and the supporting beam of a column. In lateral columns, the supporting beam may be arranged at a level that is substantially higher than the topmost radiator. To achieve more or less satisfactory results with the prior-art curtain under the effect of wind acting orthogonally, the supporting beams must be made relatively long and consequently heavy.

SUMMARY AND OBJECTS OF THE INVENTION

The primary object of the present invention is to provide an antenna curtain in which the radiators and lines of the curtain columns are supported such that sufficient distances will be maintained between the radiators and lines or between the lines under the effect of wind.

According to the invention, an antenna curtain, particularly a dipole curtain of an antenna in the decametric wave range is formed of a plurality of cables. Radiators are provided arranged essentially in a vertical plane, defining a radiator plane, in a plurality of rows located one atop another and in one column or in a plurality of columns next to one another. Line system means are provided for feeding the radiators of each column through conductive lines. A single catenary is provided to provide sufficient tension for the vertical or slightly inclined lines of the line system. An approximately horizontal spreader is arranged above each of the columns essentially perpendicular to the radiator plane. The horizontal spreader is positioned beneath the catenary and above the topmost radiator, preferably spaced a small distance in height above the topmost radiator. In the case of plural columns, horizontal spreaders are preferably arranged at equal distance in height in all columns above the topmost radiator. At least two supporting cables of the radiators and lines are provided for a column and are attached on one spreader at distances b, b1, b2 etc. The approximately vertical supporting cables or approximately vertical lines of the line system, of one column are attached at their lower ends essentially non-yieldingly and are spaced farther apart from one another at the bottom (distances a, a1, a2, etc.) than at the top such that $a > b$, $a1 > b1$, $a2 > b2$.

The present invention has the advantage that the undesired reduction in distance between lines and radiators under the effect of wind as a consequence of the swing-like rotation of the supporting beams or spreaders of the curtain columns is reduced. This can be achieved according to the present invention with the simplest means by increasing the distance between the lower points of attachment. In addition, increasing the distance at the bottom leads to greater distances between radiators and lines, as a result of which the risk of contact under load due to wind pressure is also reduced. The present invention uses, in an advantageous manner, only one catenary, on which the individual curtain columns are suspended. The individual columns are suspended according to the present invention on a spreader, which is advantageously designed such that in all columns the same distance in height is present between the spreader and the topmost radiator. This characteristic leads to improved design of the antenna curtain, because the disadvantageous great distances in height between the beam and the topmost radiator of the lateral columns are eliminated.

It is shown herein that different loads due to wind pressure on the front side and the rear side of the antenna curtain can be taken into account by providing asymmetric distances between the points of attachment (in relation to the radiator plane). In addition, the disclosed provides advantageous dimensional rules for designing an antenna curtain according to the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings.

Two exemplified embodiments of the present invention will be explained in greater detail on the basis of the drawing.

DETAILED DESCRIPTION OF THE PREFERRED EMBODIMENT

Figure 1:
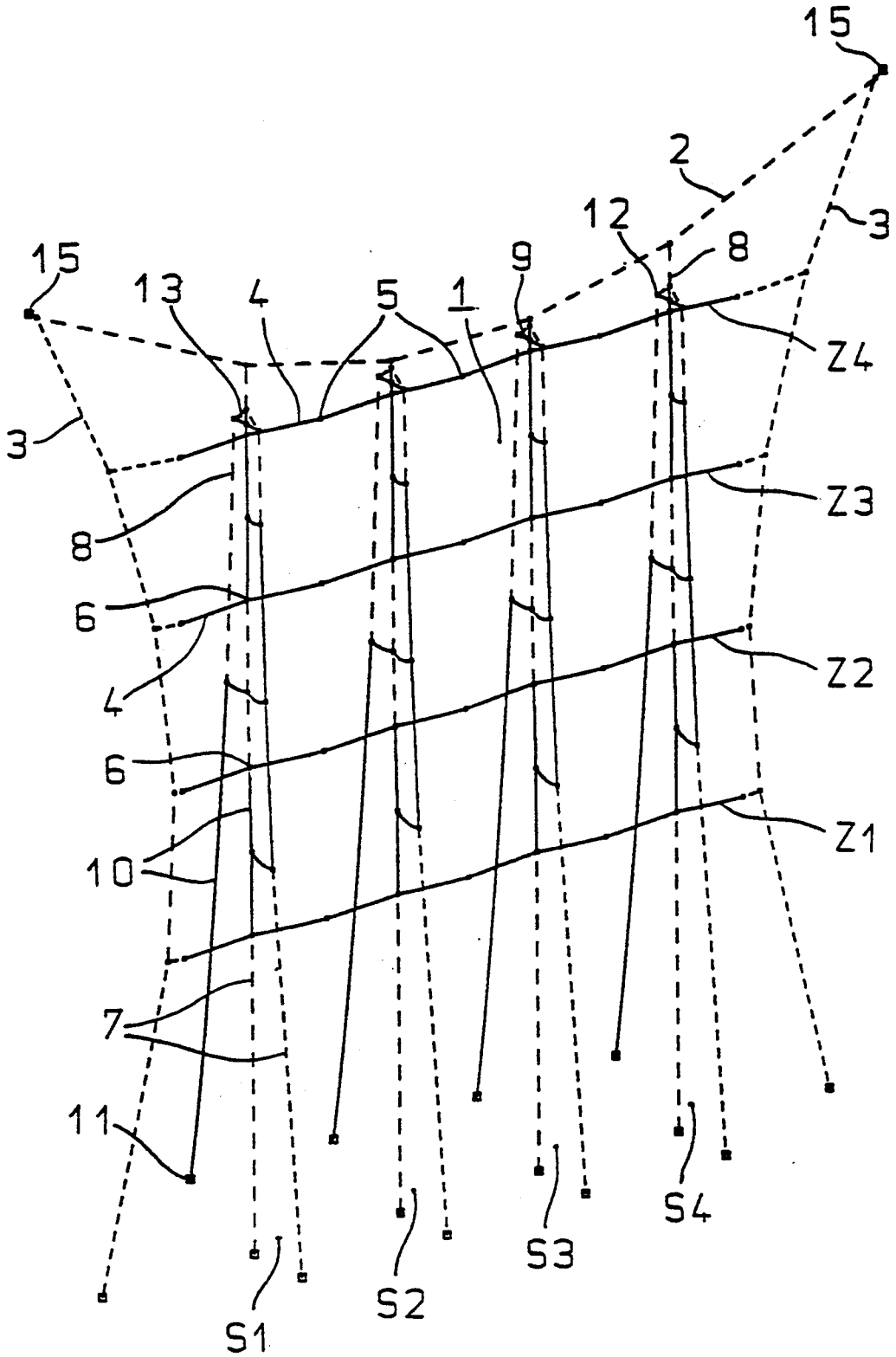
FIG. 1 is a perspective representation of an antenna curtain according to the present invention with one radiator plane and two line planes.

The antenna curtain 1 shown in FIG. 1 consists of four columns S1, S2, S3, and S4 and four rows Z1, Z2, Z3, and Z4. The rows are formed by radiators 4, which are arranged horizontally next to each other and are designed as dipole radiators. All rows of the curtain shown are suspended, with parallel distances one on top of another, in one plane, namely, the radiator plane. The columns of the curtain are imaginary planes, in which the supporting cables 8, lines 10, and holding cables 7 for radiators 4 suspended one on top of another extend. Each column is perpendicular to the radiator plane and extends vertically between the ground and a catenary 2 through the feeding points 6 of the respective radiators 4 suspended one on top of another.

In one row, the four radiators 4 are connected to one another at their ends via electrical insulators 5. The lateral ends of one row are suspended between tensioning cables 3. Three lower points of attachment 11 on the ground and three upper points of attachment 12 on a spreader 9 of a column are provided in each column. These points of attachment 12 are arranged at spaced locations in one column. The spreader 9 is suspended on the catenary 2 by means of a triangular suspension means 13 and a supporting cable 8. The catenary 2 is attached, with its ends, to tower suspension means 15, with which it is tensioned between two towers, which are not shown in FIG. 1.

The middle ones of the points of attachment 12 and 11 on the spreader 9 and on the ground, respectively, in each column define the radiator plane such that said points of attachment are located in the radiator plane. A line plane is placed between the upper and lower points of attachment located to the side from it, on each side of the radiator plane.

Figure 2:
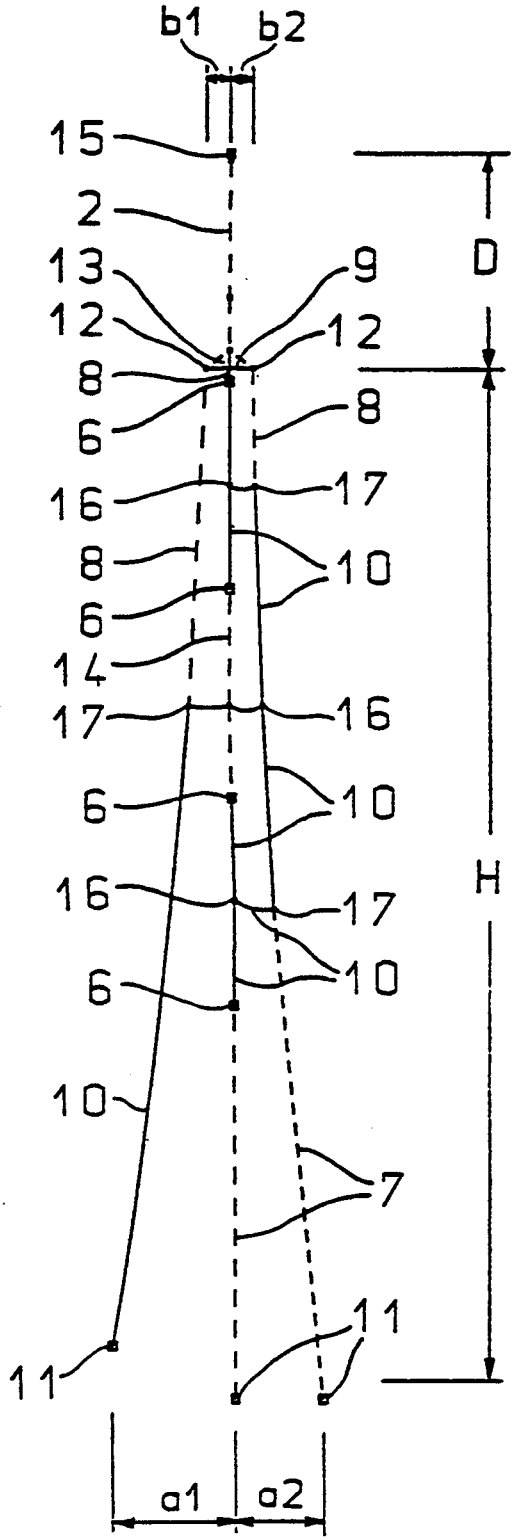
FIG. 2 is a sectional view of the antenna curtain according to FIG. 1, which is located in a column of this curtain.

FIG. 2 shows the distance ratios of the radiator and line planes. A section through the antenna curtain shown in FIG. 1, which extends within one of the columns, is represented. The spreader 9 is suspended on the catenary 2 via the triangular suspension means 13, which is formed by three converging supporting cables 8 originating from the ends and the center of the spreader 9, and the spreader 9 itself, and by a supporting cable 8 fixed to the suspension means 13. The latter supporting cable 8 is designed with different lengths for individual columns, so that the spreaders 9 of all columns are suspended at the same level above ground despite the slack curve of the catenary 2. Therefore, the distance in height between the topmost radiator 4 and the spreader 9 is also the same for all columns.

Three upper points of attachment 12 are located on the spreader 9; two of them are located at the two ends of the spreader 9, and one is in the center of the spreader 9. The two distances b1, b2 between the outer points of attachment and the central point of attachment are equal in the exemplified embodiment shown. The three points of attachment 11, which are located within the column plane are arranged at spaced locations from one another on the ground. The central one of the points of attachment 11 is arranged vertically below the central upper point of attachment 12.

The distances a1, a2 between the outer lower points of attachment 11 and the central point of attachment 11 are greater than the corresponding distances b1, b2 on the spreader 9. The distance a1, which is the left distance when viewing the sectional representation, is also greater in the exemplified embodiment than the right distance a2, in order to thus compensate for larger wind-exposed surfaces of the left lines and holding cables. The reflector curtain 18, which is generally required for the function of the antenna, is arranged on the right side at a distance d of about $\frac{1}{4}$ of the free space wavelength from the radiator plane; a2 is made somewhat smaller than this distance in order to avoid collisions between the antenna curtain and the reflector in the case of wind. In the exemplified embodiment shown, the lower distances a1, a2 are dimensioned according to the rule $a_i = [(H/D)+1]b_i$ and by multiplying the values determined by a certain factor. A value of 0.9 was selected for this factor for the distance a1, and a factor of 0.65 was selected for the distance a2. The antenna curtain as a whole is dimensioned such that the distances a1, a2, determined according to the above-described dimensional rules, will assume values that will be in the range of about $\frac{1}{8}$ to $\frac{3}{8}$ of the free space wavelength, which corresponds to the average operating frequency of the antenna curtain. In the above-described rule, H is the distance in height of a spreader 9 above the lower points of attachment; D is the distance in height between a tower suspension 15 and a spreader 9; and $b_i$ designates the distances of the upper points of attachment 12. If the lower points of attachment 11 are not located at the same level, their average height serves as a reference dimension for determining the distance in height. Likewise, in the case of different heights of the tower suspensions 15, their average height is assumed to be the reference dimension for determining the distance in height, D. The above-mentioned dimensional rule can also be applied to an antenna curtain according to FIG. 3, which has only one line plane, besides the radiator plane.

In each column, the lines 10 are led to the feeding points 6 of the radiators 4 such that four of the radiators 4, arranged one on top of another, are fed in-phase. A column is fed at the left, lower point attachment 11 (left in the direction of view to FIG. 2) via one of the lines 10. Approximately in the center of the column height, the line 10 is led over, beginning from a deflection a deflection point 17, horizontally to a distribution point 16, which is located in the right lane plane. Beginning from this the distribution point 16, one line 10 each liads downward and upward to a the deflection point 17. Beginning from these deflection points 17, the lines 10 are led from the right line plane in horizontal direction to the radiator plane. In the radiator plane, they each extend, at one of the ditribution points 16, in the upward and downward directions to the feeding points 6 of the radiators 4. the lines 10 and the radiators 4 are suspended on the supporting cables 8 and on intermediate supporting cables 14. At the points of attachment 11 in the vicinity of the ground, the lines 10 are attached either directly, by using insulators, or with holding cables 7. The holding cables 7, the supporting cables 8, and the intermediate supporting cables 14 are essentially electrically ineffective; they are made of, e.g., insulating material.

the advantageous effect of the embodiment shown on the behavior of the antenna curtain under the effect of wind can be explained, on the basis of FIG. 2, as follows, assuming, for simplicity's sake, a wind acting on the radiator plane perpendicularly; this also applies to oblique wind, because this has a vertical component. When the antenna curatain is deflected by wind forces acting on it, the spreaders 9 will be deflected as well. The change in the position of the spreaders is associated mostly with an increase in their distance from the imaginary axis passing through the two suspension points 15 and with a reduction of the average distance from the ground; these changes in distances are made possible by the yielding characteristic of the tower suspensions 15 and are the result of the tendency of the vertical or approximately vertical holding cables 7, 8 and the lines 10 to bulge out as a consequence of the effect of wind. Besides this change in distance, the spreaders especially tend—similarly to a swing—to rotate around the imaginary axis passing through the two suspension points 15, so that the leeward-side point of attachment 12 is located at a greater height above ground than the windward-side point of attachment 12. Due to the lower points of attachment 11 being arranged at the distances a1, a2, which are greater than the distances b1, b2 of the upper points of attachment 12, such that $a_i=[(H/D)+1]b_i$ applies, in which H= difference between the height of the spreader 9 and the height of the lower points of attachment 11 or, if these have different heights, between their average heights, D= difference between the height of the two tower suspensions 15 or their mean value, and the height of the spreader 9, $a_i$=-distances between the points of attachment 11 on the ground, and $b_i$=distances between the points of attachment 12 on the spreader 9, it is achieved that all the distances of the points of attachment 12 on a the spreader 9 from the respective corresponding lower point of attachment 11 remain approximately equal or decrease by approximately the same amount compared with the case without wind. As a result, the lines and holding cables of one column, which are arranged next to one another, will be deflected by approximately the same amount, so that the distances will remain approximately the same.

Certain deviations from the behavior described in a somewhat simplified and idealized form may occur in practice, e.g., when the wind-exposed surface areas on the two sides differ markedly; as was explained farther above, it is advantageous in this case to make the distances a1, a2 correspondingly different. It may be desirable or necessary for other reasons as well to deviate from the accurate dimensioning noted above (attachment points 11 being arranged at the distances a1, a2 which are greater than the distances b1, b2 of the upper points of attachment 12 such that $a_i=[(H/D)+1]\ b_i$ applies, in which H=difference between the height of the spreader 9 and the height of the lower points of attachment 11 or, if these have different heights, between their average heights, D=difference between the height of the two tower suspensions 15 or their mean value, and the height of the spreader 9, $a_i$=distances between the points of attachment 11 on the ground, and $b_i$=distances between the points of attachment 12 on the spreader 9), e.g., because of the vicinity of the reflector. A sufficient behavior can still be achieved in this case with a dimensioning within the range wherein the value $a_i$ is determined as noted above and is additionally multiplied by a factor between 0.5 and 1.5.

Especially if the distance a1, a2 is relatively short, i.e., the factor noted above (between 0.5 and 1.5) is close to 0.5, it is favorable to dimension the triangular suspension means 13 of the spreader 9 such that the spreader 9 has a triangular suspension means 13, whose height corresponds to between 0.25 and 1.0 times the length of the spreader 9 and is preferably smaller than 0.5 times the length of spreader 9. The imperfection of the realization of the ideal geometric condition has a reduced effect only, because the equilibrium position of the spreader is also determined by the magnitudes of the forces acting on it because of the small height of its suspension means.

Figure 3:
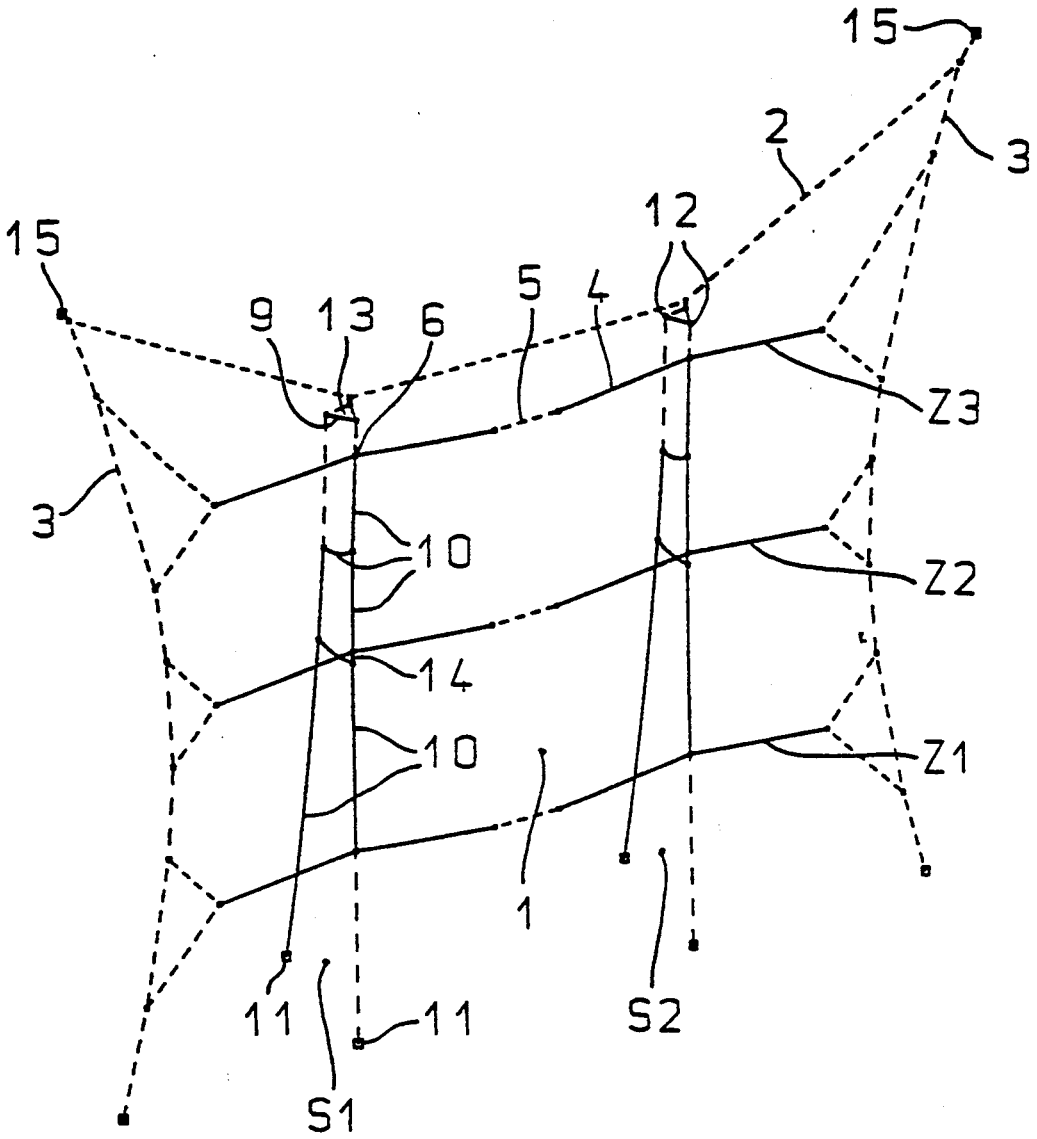
FIG. 3 is a perspective representation of an antenna curtain according to the present invention with one radiator plane and one line plane.

The antenna curtain 1 shown in FIG. 3 consists of two columns S1, S2 and three rows Z1, Z2, and Z3. The design of the rows corresponds to the above-described example.

The antenna curtain 1 shown in FIG. 3 differs from the exemplified embodiment described above with respect to the design of the columns by the fact that the curtain has only one radiator plane and one line plane.

Figure 4:
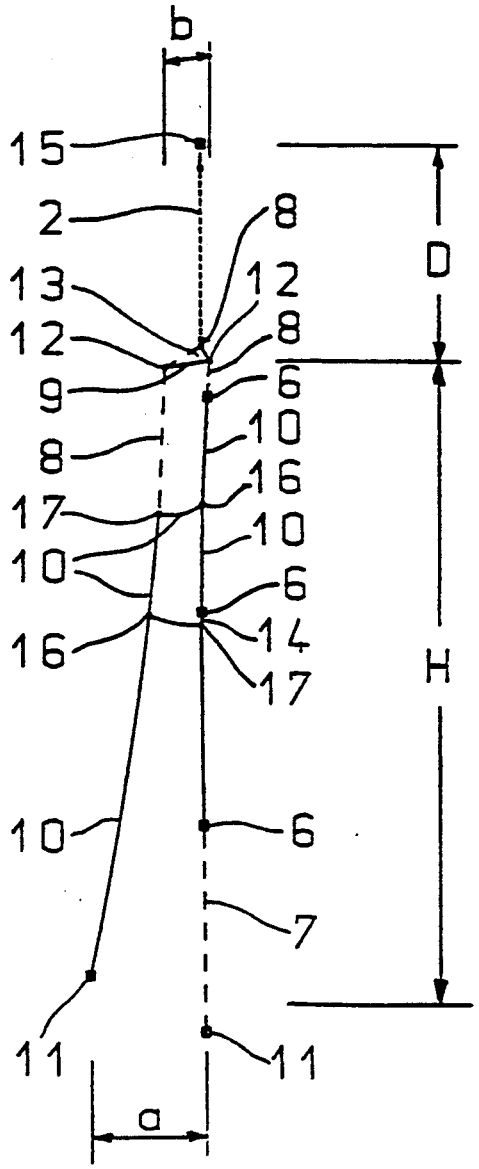
FIG. 4 is a section of the antenna curtain according to FIG. 3 which is located in a column of this curtain.
Figure 5:
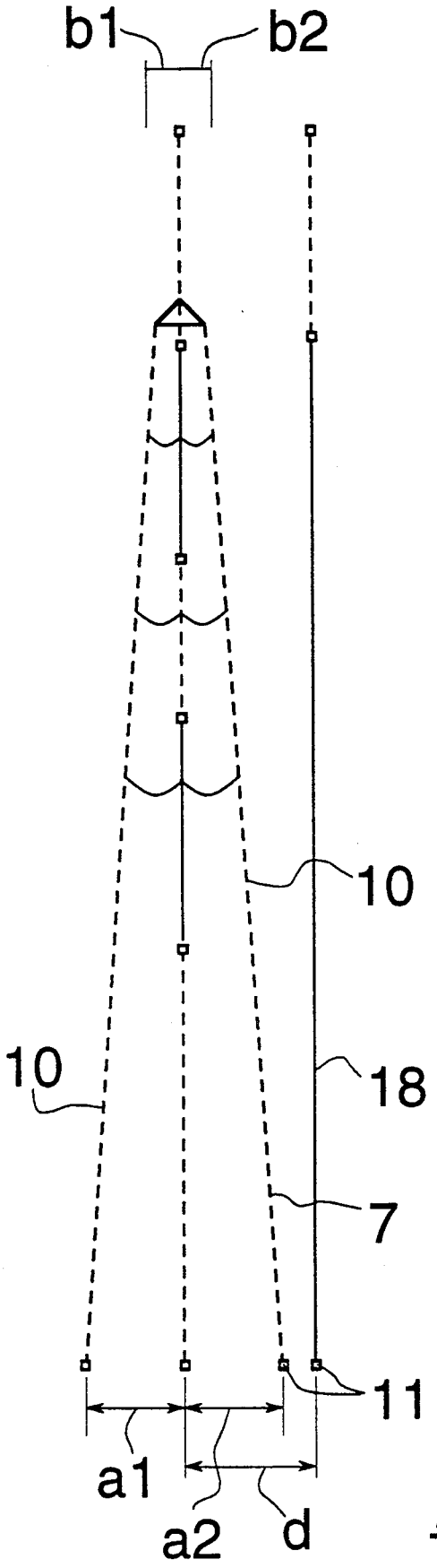
FIG. 5 is a section of the antenna curtain according to another embodiment of the invention.

Taking the above-mentioned changes into account, the distances a, b and the distances in height H, D characterized in FIG. 4 correspond to the data presented in FIG. 2. Within one column, the line arrangement and radiator suspension according to FIG. 4 are modified compared with the above-described embodiment. Feeding into a column is at the left lower point of attachment 11 via a the line 10. The line 10 leads to a the distribution point 16, which is arranged approximately in the center of the column height, and from which a horizontal branch is led to a deflection point 17 in the radiator plane, and a vertical branch is led to a deflection point 17 located above the distribution point 16 in the extension of the line 10. From the latter deflection point 17, the line 10 is led in the horizontal direction to a distribution point 16 in the radiator plane. In the radiator plane, lines 10 extend from the latter distribution point 16 in the upward and downward directions to a feeding point 6 of each of two radiators 4 arranged above each other. For the third radiator 4 located below, the line 10 is led from the deflection point 17 in the radiator plane in the downward direction to the feeding point 6 of this radiator. The lines 10 and the radiators 4 are tensioned within one column, corresponding to the above-described embodiment, between the upper points of attachment 12 on a the spreader 9 and the lower points of attachment 11 by means of supporting cables 8, intermediate supporting cable 14, and holding cable 7. The spreader 9 itself is suspended via a triangular suspension means 13 with a short supporting cable 8 on a catenary 2, which is tensioned between two tower suspensions 15.

The antenna reflector, which is tensioned, in the known manner, with a large surface area on one side of the antenna curtain and at a spaced location from it, is not shown in the drawing for either of the two exemplified embodiments.

While specific embodiments of the invention have been shown and described in detail to illustrate the application of the principles of the invention, it will be understood that the invention may be embodied otherwise without departing from such principles.

What is claimed is:

1. An antenna dipole curtain in the decametric wave range, comprising:

radiators arranged essentially in a vertical plane defining a radiator plane, the radiators being in a plurality of rows located one on top of another to form a column;

line system means for feeding the radiators of said column, said line system means including conductive lines;

only one catenary extending above said column and supported at each of two ends;

an approximately horizontal spreader arranged above said column, said horizontal spreader being arranged essentially perpendicular to said radiator plane, said horizontal spreader being arranged beneath said catenary and said horizontal spreader being positioned above a topmost one of said radiators;

at least two supporting cables in said column for supporting said radiators and said conductive lines, said supporting cables being attached on said spreader at distances b, b1, b2, . . . , from the radiator plane and holding cables equal in number to said supporting cables attached on said spreader and attached at lower ends of said column, essentially non-yieldingly and spaced apart from one another by distances a, a1, a2, . . . , distance a being greater than distance b, distance a1 being greater than distance b1, and distance a2 being greater than distance b2.

2. An antenna curtain according to claim 1, wherein said spreader has a triangular suspension means with a height corresponding to between 0.25 and 1.0 times the length of said spreader.

3. An antenna curtain according to claim 2, wherein said height of said triangular suspension means is smaller than 0.5 times the length of said spreader.

4. An antenna curtain according to claim 1, further comprising a reflector located in a reflector plane on one side of said radiator plane wherein a distance of a lower point of attachment of said conductive lines or said holding cables which conductive line or holding cable is arranged at a spaced location from the radiator plane on a side of the antenna curtain on which said reflector is located, from the radiator plane is smaller than or equal to a distance between said radiator plane and said reflector plane.

5. An antenna curtain according to claim 4, wherein said conductive lines and the lower points of attachment of said conductive lines are provided on both sides of said radiator plane wherein said distances a1, a2 between the lower points of attachment and the radiator plane are each greater on the side on which the lines and holding cables have a larger wind-exposed surface area.

6. An antenna curtain according to claim 1, wherein said distances a, a1, a2, etc. of lower points of attachment of said column are in a range of about $\frac{1}{8}$ to $\frac{3}{8}$ of a wavelength, which is a free space wavelength belonging to an average operating frequency.

7. An antenna curtain according to claim 1, wherein said catenary is supported by two tower suspensions and $$a_i=[(H/D)+1]b_i$$

where H=difference between a height level of said spreader and the height level of said lower points of attachment or, if said lower points of attachment are arranged at different levels, the average of height levels of said lower points of attachment, D=difference between a height level of two tower suspensions connected to said catenary or the mean value of the height levels of said two tower suspensions, and the height level of said spreader, $a_i$=distances between the points of attachment on the ground, and $b_i$=distances between the points of attachment on the spreader.

8. An antenna curtain according to claim 7, wherein said value $a_i$ is multiplied by a factor of between 0.5 and 1.5.

9. An antenna dipole curtain according to claim 1, wherein at least one additional; column is provided wherein said additional column is arranged next to said column.

10. An antenna dipole curtain according to claim 9, wherein said horizontal spreader is arranged a small distance in height above a top most one of said radiators in said column and is spaced from a top most radiator by said small distance in said additional column.

11. An antenna dipole curtain according to claim 1, wherein said horizontal spreader is positioned above said top most one of said radiators at a small distance in height above said top most one of said radiators.

* * * * *